US005458325A

United States Patent [19]

Klein David A. et al.

[11] Patent Number: 5,458,325

[45] Date of Patent: Oct. 17, 1995

[54] WEATHER-RESISTANT BASKETBALL NET

[76] Inventors: David A. Klein; Steven M. Klein, both of 3567 Grand Avenue #267, Gurnee, Ill. 60031

[21] Appl. No.: 364,808

[22] Filed: Dec. 27, 1994

[51] Int. Cl.[6] ..... A63B 63/08

[52] U.S. Cl. ..... 273/1.5 R; 273/15 A

[58] Field of Search ..... 273/1.5 R, 1.5 A

[56] References Cited

U.S. PATENT DOCUMENTS

| | | | |
|---|---|---|---|
| Re. 15,739 | 1/1924 | Jackson, Jr. | 273/1.5 R |
| 2,199,609 | 5/1940 | Bennett | 273/1.5 R |
| 2,579,312 | 12/1951 | Garvey | 273/1.5 R |
| 3,109,647 | 11/1963 | Austin | 273/1.5 R |
| 4,877,241 | 10/1989 | Rothbard | 273/1.5 R |
| 5,098,091 | 3/1992 | McGivern | 273/1.5 R |

*Primary Examiner*—Paul E. Shapiro
*Attorney, Agent, or Firm*—Erik M. Arnhem

[57] ABSTRACT

A basketball net is formed of six U-shaped strands of stiff, flexible weather-resistant material, joined together at spaced points by small connector clips. Each strand preferably is a steel cable having a plastic coating or sheath, that provides distinctive coloration and oxidation protection for the cable.

6 Claims, 2 Drawing Sheets

WEATHER-RESISTANT BASKETBALL NET

BACKGROUND AND SUMMARY OF THE INVENTION

This invention relates to a basketball net, particularly a basketball net resistant to the weather elements, whereby the net can be used in outdoor environments.

Conventional basketball nets are commonly formed of string or twine sewn at spaced points to provide an annular (tubular) net structure. The string or twine can be formed out of cotton, nylon or other commercially available materials.

The materials used in such conventional basketball nets are not resistant to the weather elements, e.g. heat, cold, snow, ice, wind and rain. Consequently, it was necessary to remove the net from the basketball hoop during the winter months.

Nets formed of metallic chain materials have been devised to provide nets having improved weather resistance. However, such metallic chain nets sometimes deteriorate due to oxidation. Also, such nets tend to tangle during use. Additionally, the hard chain surfaces can cause injury to a person's hand when the person is attempting to grab a rebound or deflect the basketball away from the basket.

The patent literature includes several patents showing basketball nets formed of plastic materials.

U.S. Pat. No. 2,579,312, to G. Garvey, shows a net that is apparently formed as a one-piece plastic molding. The patent mentions as suitable materials polystyrene, polyethlene and silicone rubber. The patent shows a downwardly-convergent frusto-conical structure having a number of straps at its upper end for attaching the net to a basketball hoop. It is believed that the net would have limited flexibility and weather resistance.

U.S. Pat. No. 3,109,647, issued to R. Austin, shows a net formed of a foraminous plastic sheet curved into a frusto-conical net structure that is in many respects similar to the molded net structure shown in the Garvey U.S. Pat. No. 2,579,312.

U.S. Pat. No. 4,834,368, granted to P. Qualley, shows a basketball net formed of nylon cord, and having a hoop attachment band at its upper end, whereby the net can be more easily attached to the hoop. The attachment band has mating adhesive sections extending along its border, whereby the band can be folded over the hoop to attach the band to the hoop.

The present invention concerns a basketball net formed out of a plurality U-shaped strands arranged in an annular array around a central vertical axis. Each U-shaped strand is preferably a stiff flexible steel cable having a plastic sheath or covering, whereby a person's hand is not susceptible to being injured due to contact with the plastic surface. The steel cable provides strength to the net structure, while the plastic covering provides weather resistance.

The stiffness of the steel cable is advantageous in that the net configuration can be achieved with only a few U-shaped strands; typically six U-shaped strands are employed.

The stiffness of the steel cable is further advantageous in that it gives the net a radial resilience, whereby the net annulus can have a normal diameter less than the diameter of a basketball while being radially expandable due to passage of the ball through the net. As the net strands expand radially a distinctive snapping sound is generated, signifying the passage of the ball through the net.

A principal aim of the invention is to provide a basketball net having a relatively long service life when exposed to the weather elements. Features of the invention will be apparent from the attached drawing.

THE DRAWINGS

FIG. 1 is a side elevational view of a basketball net constructed according to the invention. The net is shown installed below a conventional basketball hoop. Also, a conventional basketball is shown above the hoop to indicate the size relationships between the ball, hoop and the net.

DESCRIPTION OF A PREFERRED EMBODIMENT OF THE INVENTION

Figure 1:
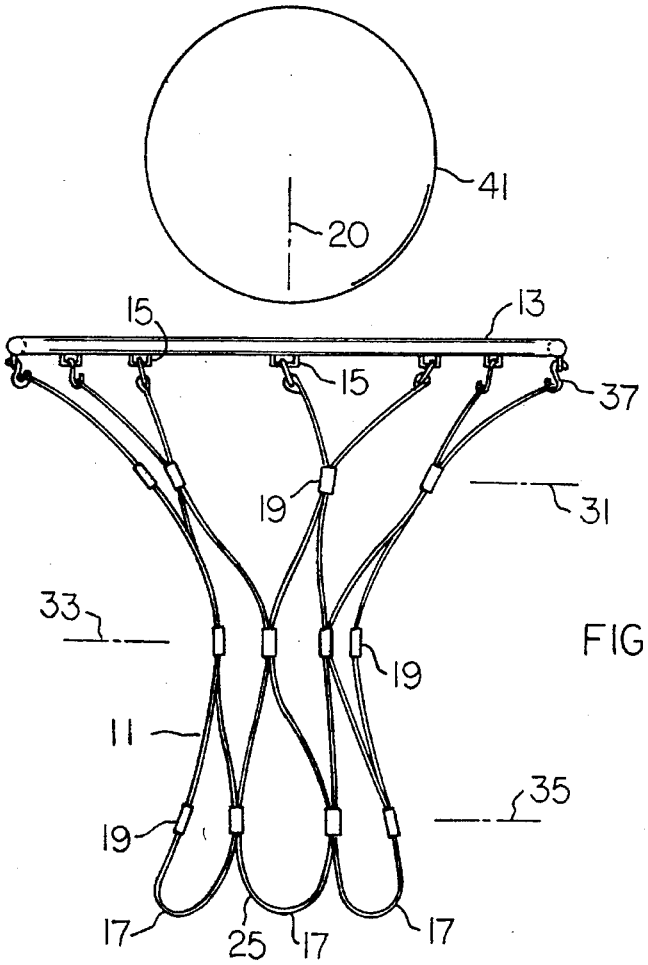
Figure 2:
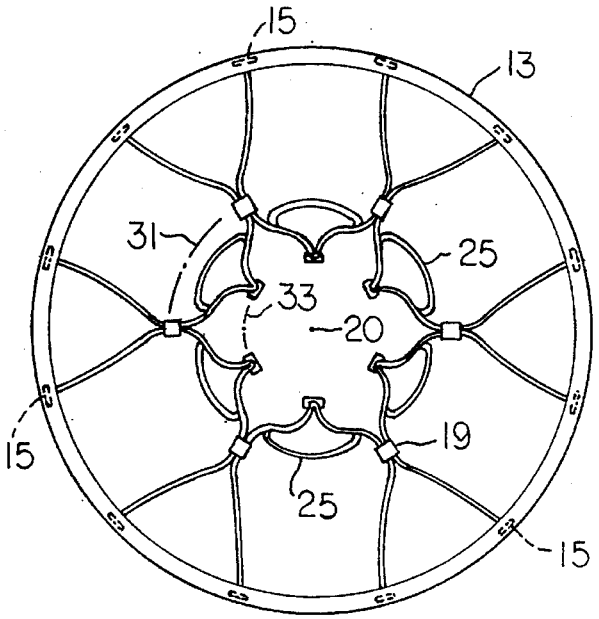
FIG. 2 is a top plan view of the net construction depicted in FIG. 1.

The drawings show an annular basketball net 11 attachable to a conventional circular hoop 13. Typically, the hoop is formed of a steel rod having a circular cross section; the rod is bent into a circular configuration to define a rigid circular hoop (annulus) having an internal diameter of about seventeen inches.

Hoop 13 is equipped with twelve depending brackets 15 spaced equidistantly around the hoop circumference. Each bracket can be a U-shaped wire element having its upper ends welded to the undersurface of hoop 13, whereby the brackets collectively form a suspension structure for net 11, or any conventional net construction that might be used with the hoop.

Net 11 comprises six upright U-shaped strands 17 joined together by multiple connector clips 19. Each clip 19 comprises an endless annular band encircling two strand sections in a clamped relationship, whereby the strand sections are affixed together by the connector clips.

Figure 3:
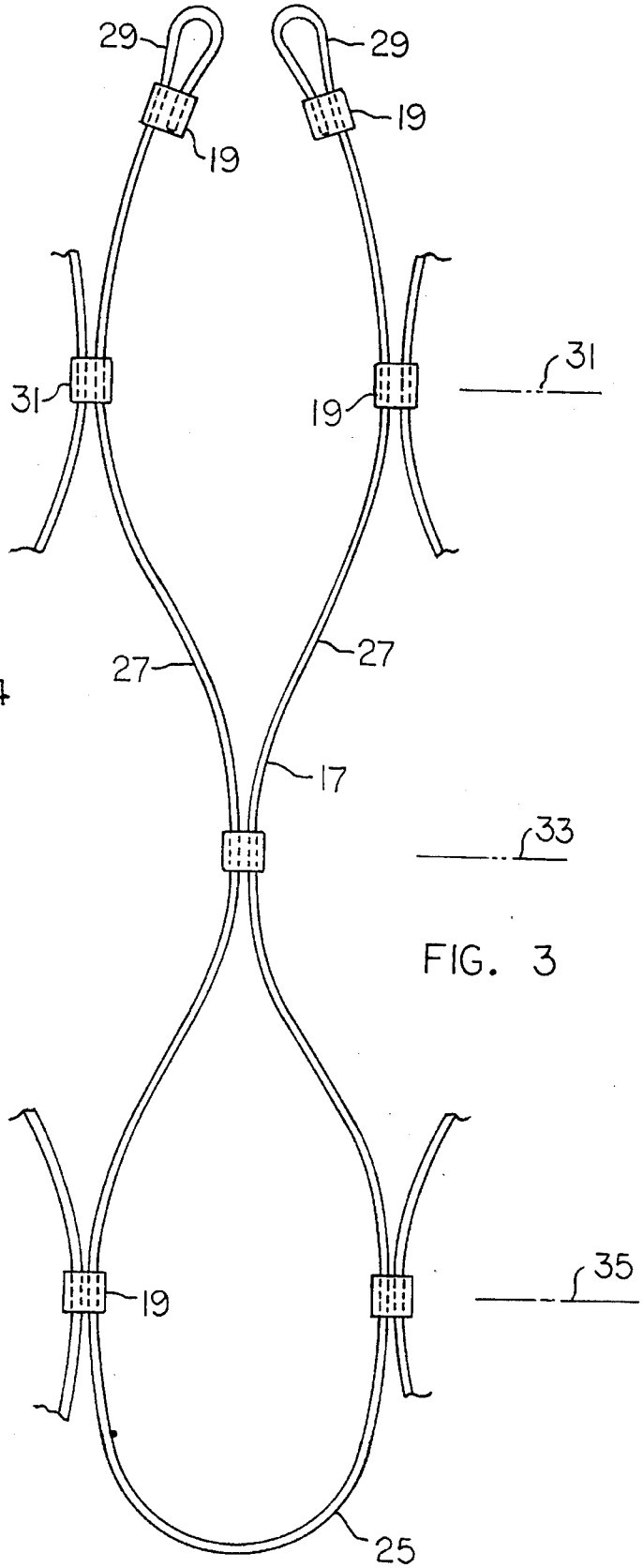
FIG. 3 is an enlarged fragmentary elevational view of the U-shaped strand element used in the FIG. 1 net construction.

FIG. 3 shows the connector clip cross section after the clip has been crimped to two strand sections. Initially each connector clip has a slidable fit on the strands; when the opposed side walls of the clip are forced together, as indicated by the arrows in FIG. 5, the clip surfaces clamp against the strand surfaces so that the clip rigidly connects the two strand sections together.

Each U-shaped strand is formed out of a steel cable 21 (FIG. 5) encapsulated within a plastic sleeve, or sheath 23. The plastic sleeve can be a vinyl plastic material applied to the steel cable by an extrusion process, that involves passage of the cable through an extrusion die supplied with the heated molten plastic. The diameter of the plastic-coated cable is typically about 0.13 inch.

The steel cable 21 is preferably formed out of three or four steel wires wound helically on one another to form a stiff high strength cable construction. The plastic coating on the cable isolates the cable from oxidation and corrosion associated with exposure to the weather elements. Also, the plastic coating provides a relatively soft smooth surface that is less likely to cause injury to a person's hand, e.g. should the person strike his or her hand against the net while attempting to reach the basketball or while attempting to direct the ball through the hoop into the net.

The plastic coating on the steel cable can be a colored transparent material having coloring incorporated into the molding compound, so that the colored strand retains its initial appearance even after extensive exposure to the weather elements. The plastic coating provides weather protection for the steel cable, and also a long-lasting translucent coloring for each U-shaped strand.

As before noted, net 11 is comprised of six U-shaped strands 17. The strands are joined together by the various conector clips 19 to define an annular array of strands centered on a vertical axis 20. When the upper ends of strands 17 are attached to the aforementioned brackets 15 the net will be suspended from the hoop 13, as depicted in FIG. 1.

FIG. 3 shows a representative U-shaped strand 17, and its connections with the neighboring strands (shown fragmentarily in FIG. 3). The U-shaped strand comprises a single continuous strand bent to form a U bend 25 and two upright strand sections 27, 27. The upper terminal ends of strand sections 27 are doubled back and joined together by connector clips 19 to form attachment eyes 29. Each attachment eye 29 is used to attach the net to a selected one of the wire brackets 15 on hoop 13.

The helically wound steel cable in each U-shaped strand 17 contributes a stiffness to the strand, such that in its natural state the strand would have a linear (straight) configuration. The strand is passed through a system of rollers to bend the steel cable into a U-configuration. Bending rollers are also used to form the attachment eyes 29.

Figure 6:
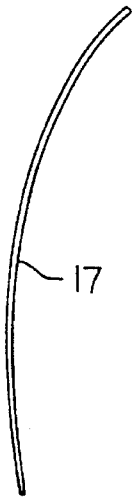
FIG. 6 is a side elevational view, taken on a reduced scale, showing the U-shaped strand of FIG. 3

After each individual strand has been bent into its U-configuration, as shown in FIG. 3, the U-shaped strand is passed through other bending rollers to bend the strand in a plane normal to the U, such that the strand is curved in two orthogonal planes. FIG. 6 depicts the curvature of strand 17 in a plane normal to the plane of FIG. 3.

Figure 4:
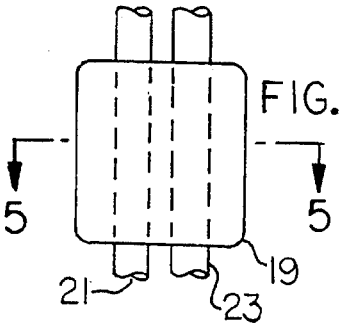
FIG. 4 is an enlarged view of a strand connector used in the FIG. 1 net construction.
Figure 5:
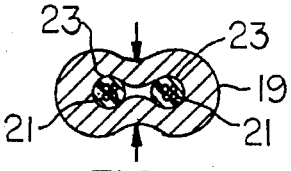
FIG. 5 is a transverse sectional view taken on line 5—5 in FIG. 4.

The six U-shaped strands are connected together by three rows of connectors 19, namely an upper row designated by numeral 31, an intermediate row designated by numeral 33 and a lower row designated by numeral 35. Each connector is constructed as shown in FIGS. 4 and 5.

The connectors in upper row 31 join the strand sections of adjacent U-shaped strands 17. Similarly, the connectors in lower row 35 join the strand sections in adjacent U-shaped strands 17. However, the connectors in intermediate row 33 join the strand sections in only one of the U-shaped strands. Thus, intermediate areas of the strand sections 27 in each U-shaped strand 17 are drawn together by the intermediate row of connectors, to give the strands the hour glass appearance depicted in FIG. 3. The connectors in row 33 are closer to axis 20 than the connectors in rows 31 and 35.

The six U-shaped strand 17 are centered around a central vertical axis 20 to provide an annular (tubular) net configuration. Preferably the various connector clips 19, in rows 31, 33 and 35, are crimped onto the strand sections after the six U-shaped strands have been positioned in an annular support fixture.

The formed net construction has a sufficient stiffness and coherence that the attachment eyes 29 will be in common plane at one end of the strand assembly. The strand assembly is preferably attached to hoop 13 by means of S-shaped hooks 37. Each hook has its upper end extending into one of the brackets 15, and its lower end extending through one of the attachment eyes 29. The net is thereby suspended from hoop 13, as depicted in FIG. 1.

The three rows of connectors 31, 33 and 35 are widely spaced in the vertical direction such that the various strand sections 27 can deflect radially outwardly away from vertical axis 20 when the basketball drops through the net. FIG. 1 shows a conventional basketball 41 above hoop 13. The diameter of the ball is somewhat greater than an imaginary diameter formed by the intermediate row of connectors 33 in the net. Therefore, as the ball descends through the net, the ball will spread the strand sections apart, i.e. away from vertical axis 20.

The relatively large vertical spacing of the three rows of connectors 31, 33 and 35 enables each strand section to deflect radially an appreciable distance, e.g. when ball 41 drops through the net. Typically the vertical spacing between rows 31 and 33 is about five or six inches; there is a similar vertical spacing between rows 33 and 35.

The diameter of basketball 41 is usually about nine and one-half inches, whereas the diameter of the space circumscribed by the intermediate row of connectors 33 may be about eight inches. When the ball falls through the net the radial deflection of the net material produces a distinctive snapping noise that provides an audible indication that a goal has been scored. This somewhat adds to the enjoyment of the game.

The relatively small diameter of the net (in the plane of connector row 33) may also be advantageous in that the net has a relatively slender appearance. Such a slender appearance narrows the target in the eyes of the shooter, whereby the shooter may tend to improve his or her shooting skills over time.

The principal feature of the basketball net is its weather resistance, whereby the net can be used for prolonged periods in outdoor environments, without deterioration.

The steel cables provide desired strength and stiffness, such that the net material is not likely to experience fatigue failure. The plastic coating on the steel cable shields the cable from oxidation and corrosion. Also the plastic is adherent on the steel so that the plastic is not likely to contract or expand due to temperature changes. The resultant net construction has desired weather-resistance properties.

What is claimed is:

1. An annular basketball net attachable to a circular hoop, comprising:

a plurality of upstanding U-shaped strands formed of a stiff flexible weather-resistant material, and a plurality of connectors joining said strands to define an annular array of strands centered on a vertical axis;

each U-shaped strand comprising a single continuous strand forming two upright strand sections, and a U bend joining the lower ends of said strand sections; each upright strand section having an attachment eye at its upper end for suspending the net from a basketball hoop;

said connectors comprising an upper row of connectors joining the strand sections of adjacent U-shaped strands, an intermediate row of connectors joining the strand sections in each U-shaped strand, and a lower row of connectors joining the strand sections of adjacent U-shaped strands;

the connectors in each row of connectors being circumferentially spaced;

said rows of connectors being widely spaced in the vertical direction, whereby said strands can deflect radially away from said vertical axis when a basketball descends through the space circumscribed by the array of U-shaped strands.

2. The basketball net of claim 1, wherein each U-shaped strand comprises a steel cable encapsulated in a plastic sleeve.

3. The basketball net of claim 2, wherein each steel cable is bent so as to be in an arcuate plane, wherein the connectors in the intermediate row are relatively close to said vertical axis, and the connectors in the other two rows are relatively remote from said vertical axis.

4. The basketball net of claim 3, wherein the connectors in the intermediate row are normally spaced from said vertical axis a lesser distance than the radius of a conventional basketball.

5. The basketball net of claim 2, wherein each steel cable comprises a multiplicity of steel wires helically wound on each other.

6. The basketball net of claim 2, wherein there are six U-shaped strands.

* * * * *